US008944567B2

(12) United States Patent
Domae

(10) Patent No.: US 8,944,567 B2
(45) Date of Patent: Feb. 3, 2015

(54) LIQUID JET HEAD AND LIQUID JET APPARATUS

(71) Applicant: SII Printek Inc., Chiba (JP)

(72) Inventor: Yoshinori Domae, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 14/199,657

(22) Filed: Mar. 6, 2014

(65) Prior Publication Data

US 2014/0267500 A1 Sep. 18, 2014

(30) Foreign Application Priority Data

Mar. 12, 2013 (JP) ..... 2013-049547

(51) Int. Cl.
*B41J 2/04* (2006.01)
*B41J 2/045* (2006.01)

(52) U.S. Cl.
CPC ..... *B41J 2/045* (2013.01)
USPC ..... 347/54; 347/68

(58) Field of Classification Search
CPC .... B41J 2/045; B41J 2/04581; B41J 2/14233; B41J 2/14; B41J 2/14274
USPC ..... 347/20, 54, 68, 69
See application file for complete search history.

(56) References Cited

U.S. PATENT DOCUMENTS

| | | | | |
|---|---|---|---|---|
| 6,863,383 | B2 * | 3/2005 | Takahashi | 347/72 |
| 8,052,253 | B2 * | 11/2011 | Wee et al. | 347/70 |
| 8,104,858 | B2 * | 1/2012 | Kato et al. | 347/17 |
| 2007/0263041 | A1 | 11/2007 | Owaki | 347/71 |

FOREIGN PATENT DOCUMENTS

| | | |
|---|---|---|
| EP | 0855724 | 7/1998 |
| EP | 0985535 | 3/2000 |
| EP | 1547775 | 6/2005 |
| EP | 2316649 | 5/2011 |
| EP | 2540503 | 1/2013 |
| JP | 2005014618 | 1/2005 |

OTHER PUBLICATIONS

IPO Search Report mailed Aug. 26, 2014 issued in GB Patent Appln. No. GB1403959.8.

* cited by examiner

*Primary Examiner* — An Do
(74) *Attorney, Agent, or Firm* — Adams & Wilks

(57) ABSTRACT

A liquid jet head is provided with: a nozzle plate which includes a nozzle array having a plurality of nozzle holes arranged side by side along a Y direction; an actuator plate which is laminated on the nozzle plate and includes a channel group having a plurality of first channels communicating with the nozzle holes, the first channels being arranged in parallel at intervals along the Y direction; and an inlet ink chamber and an outlet ink chamber both communicating with the first channels on opposite ends in an extending direction of the first channels. A film member which can be warp-deformed along with pressure fluctuation inside the inlet ink chamber and the outlet ink chamber is arranged as a part of inner surfaces of each of the inlet ink chamber and the outlet ink chamber.

7 Claims, 10 Drawing Sheets

LIQUID JET HEAD AND LIQUID JET APPARATUS

BACKGROUND

1. Technical Field

The present invention relates to a liquid jet head and a liquid jet apparatus.

2. Related Art

Conventionally, there has been used an ink jet printer (liquid jet apparatus) that is provided with an ink jet head (liquid jet head) as an apparatus that ejects ink in the form of liquid droplets onto a recording paper (recording medium) to record an image or a character thereon.

Generally, an ink jet head is provided with a nozzle plate which has a nozzle array including a plurality of nozzle holes, an actuator plate which has a plurality of channels communicating with the respective nozzle holes, and a cover plate which has a common ink chamber communicating with the channels. In such a configuration, a channel is caused to contract to increase the pressure inside thereof, thereby ejecting ink inside the channel from the corresponding nozzle hole to allow the ink to adhere on a recording paper.

However, in the above ink jet head, for example, pressure fluctuation inside a channel which occurs when ejecting ink is disadvantageously transmitted as a pressure wave to the common ink chamber and the other channels through the common ink chamber, which affects the ejection performance (printing stability). Specifically, a pressure wave which is generated when driving one or more channels is transmitted to the common ink chamber, and affects ejection of ink as a frequency component other than a resonance frequency of a pressure wave to be generated for ejecting ink inside the other channels. As a result, influence such as an increase or decrease in the speed of the ejection is caused. At the same time, the volume of ink droplets also decreases or increases, which affects the image quality on a recording paper. In addition, the pressure fluctuation becomes large when the ejection amount per unit time increases or the size of liquid droplets increases.

For example, JP 2005-14618 A discloses a so-called edge shoot type head chip in which nozzle holes are arranged on first ends in the extending direction of channels, and ink is supplied into the channels from a common ink chamber which is arranged on second ends in the extending direction of the channels. In the disclosed head chip, a thin pressure fluctuation buffering portion is formed in the common ink chamber in order to buffer pressure fluctuation inside the common ink chamber.

SUMMARY

The above ink jet head also includes a so-called side shoot type ink jet head which has nozzle holes communicating with channels at intermediate positions in the extending direction thereof. In the side shoot type ink jet head, each of the channels communicates with common ink chambers on the opposite ends in the extending direction thereof.

In this case, in the configuration disclosed in JP 2005-14618 A, the pressure fluctuation buffering portion is arranged only on the second ends of the channels. Therefore, when such a configuration is applied to the side shoot type ink jet head, it is difficult to effectively suppress pressure fluctuation that occurs inside the channels.

Further, the side shoot type ink jet head includes a circulation type ink jet head. The circulation type ink jet head has two common ink chambers. One of the common ink chambers is set as an inlet side common ink chamber, and the other one of the common ink chambers is set as an outlet side common ink chamber. Ink is circulated between an ink tank and the ink jet head. In the circulation type ink jet head, whether which one of the two common ink chambers is set as the inlet side (or outlet side) common ink chamber may be determined according to the specification of an ink system of a printer. Therefore, it is desired to cope with both cases.

The present invention has been made in view of the above circumstances, and is directed to provide a liquid jet head that can obtain a sufficient pressure buffering effect and has high versatility, and a liquid jet apparatus provided with the same.

The present invention provides the following means in order to solve the above problem.

(1) A liquid jet head according to present invention is provided with: a jet hole plate including at least one jet hole array having a plurality of jet holes configured to jet liquid therefrom, the jet holes being arranged side by side along a first direction; an actuator plate laminated on the jet hole plate, the actuator plate including at least one channel group having a plurality of channels communicating with the jet holes, the channels being arranged in parallel at intervals along the first direction; and a first common liquid chamber and a second common liquid chamber both communicating with the channels on opposite ends in an extending direction of the channels. In the liquid jet head, a pressure buffering portion configured to be warp-deformable along with pressure fluctuation inside the first common liquid chamber and the second common liquid chamber is arranged as a part of inner surfaces of each of the first common liquid chamber and the second common liquid chamber.

According to such a configuration, the pressure buffering portion which forms a part of the inner surfaces of each of the common liquid chambers is warp-deformed in response to pressure fluctuation inside the liquid jet head, thereby making it possible to buffer the pressure fluctuation. For example, when liquid is jetted from a jet hole due to a decrease of the capacity of a channel, the pressure inside the channel instantaneously decreases. Accordingly, pressure fluctuation inside the channel is transmitted as a pressure wave to each of the common liquid chambers, and the pressure buffering portion is thereby warp-deformed. That is, the pressure buffering portion is warp-deformed so as to reduce the capacity of each of the common liquid chambers. As a result, the pressure fluctuation occurring inside the channel can be buffered inside the common liquid chambers, and the liquid jet head with excellent liquid jet performance (printing stability) can therefore be provided.

In this case, since the pressure buffering portion is arranged in each of the common liquid chambers, it is possible to effectively buffer the pressure fluctuation inside the liquid jet head.

Further, by arranging the pressure buffering portion in both of the common liquid chambers, for example, when the circulation type liquid jet head as described above is employed, either of the common liquid chambers can be set as an inlet side common liquid chamber (or an outlet side common liquid chamber). Therefore, a circulation direction of ink is not restricted depending on the specification of a liquid system of the liquid jet apparatus. As a result, it is possible to have flexibility in the configuration of the liquid system.

Especially when the circulation type liquid jet head is employed, the inlet side common liquid chamber is maintained at a positive pressure relative to the pressure inside the channels, and the pressure buffering portion is thereby in a swelling state toward the inlet side common liquid chamber. Therefore, by providing the pressure buffering portion in the inlet side common liquid chamber, it is possible to ensure the warpage amount of the pressure buffering portion due to pressure fluctuation, and thereby improve the buffer action.

Further, according to the configuration of the present invention, by providing the pressure buffering portion in both of the common liquid chambers, the pressure buffering portion is always provided in the inlet side common liquid chamber regardless of the specification of the liquid system of the liquid jet apparatus. Therefore, it is possible to reliably obtain high pressure buffering effect by the pressure buffering portion.

(2) In the above liquid jet head according to the present invention, the pressure buffering portion may be arranged as a part of the inner surfaces of each of the first common liquid chamber and the second common liquid chamber, the part facing the channels.

According to such a configuration, since the pressure buffering portion is arranged as a part of the inner surfaces of each of the first common liquid chamber and the second common liquid chamber, the part facing the channels. Therefore, pressure waves transmitted from the channels are easily transmitted to the pressure buffering portion. As a result, it is possible to more effectively buffer the pressure fluctuation.

(3) In the above liquid jet head according to the present invention, the at least one jet hole array formed in the jet hole plate may include a plurality of jet hole arrays, and the at least one channel group formed in the actuator plate may include a plurality of channel groups, and the first common liquid chamber may communicate with ends on a first side in the extending direction of the channels in one of the channel groups and ends in a second side in the extending direction of the channels in another one of the channel groups adjacent to the one channel group.

According to such a configuration, the plurality of jet hole arrays are formed on the jet hole plate, and the plurality of channel groups are formed on the actuator plate. Therefore, it is possible to narrow a dot pitch at the time of printing. As a result, the resolution of printing can be improved.

Further, the first common liquid chamber communicates with the ends on the first side in the extending direction of the channels in one of the channel groups and the ends on the second side in the extending direction of the channels in another one of the channel groups adjacent to the one channel group. Therefore, the first common liquid chamber is common between adjacent channel groups. In this case, the area of the pressure buffering portion can be easily ensured by arranging the pressure buffering portion as a part of the inner surfaces of the first common liquid chamber, the part facing the channels, as described above. As a result, it is possible to ensure the warpage amount of the pressure buffering portion, and thereby further improve the pressure buffering effect.

(4) In the above liquid jet head according to the present invention, a sway space configured to allow warp-deformation of the pressure buffering portion may be defined on an outer surface side of the pressure buffering portion, and the sway space may communicate with the outside through an air release hole.

According to such a configuration, since the sway space is exposed to the outside through the air release hole, it is possible to suppress the pressure fluctuation inside the sway area caused by temperature change or the like. As a result, the pressure buffering effect by the pressure buffering portion can be always maintained constant.

(5) In the above liquid jet head according to the present invention, the first common liquid chamber and the second common liquid chamber may be defined by a first slit and a second slit communicating with the channels and the pressure buffering portion configured to block the first slit and the second slit, and the pressure buffering portion may be a flexible film configured to be warp-deformable.

According to such a configuration, since the pressure buffering portion is formed by the separate flexible film which blocks the first slit and the second slit, a sufficient pressure buffering effect can be easily obtained irrespective of the material forming the first slit and the second slit. In this case, it is also possible to adjust a desired pressure buffering effect, for example, by selecting the material, the thickness and the like of the flexible film.

(6) In the above liquid jet head according to the present invention, the flexible film may be formed across the first slit and the second slit.

According to such a configuration, since the flexible film is formed across the first slit and the second slit, it is possible to reduce the number of components and improve the manufacturing effect compared to a configuration in which the first and second slits are covered by respective different flexible films.

(7) A liquid jet apparatus according to the present invention is provided with: the liquid jet head of the present invention; a conveyance unit configured to relatively move the liquid jet head and a recording medium; a liquid tank configured to store therein the liquid; and a circulation unit configured to circulate the liquid between the liquid jet head and the liquid tank.

According to such a configuration, since the liquid jet apparatus is provided with the liquid jet head of the present invention, it is possible to maintain a stable liquid ejection performance (printing stability) for a long period of time, and provide the liquid jet apparatus having high versatility.

According to the present invention, it is possible to obtain a sufficient pressure buffering effect and provide the liquid jet head and the liquid jet apparatus having high versatility.

DETAILED DESCRIPTION

Hereinbelow, an embodiment of the present invention will be described with reference to the accompanying drawings. In the following embodiment, an ink jet printer (hereinbelow, just referred to as the printer) that uses ink (liquid) to perform recording on a recording paper will be described as an example of a liquid jet apparatus that is provided with a liquid jet head of the present invention.

[Printer]

Figure 1:
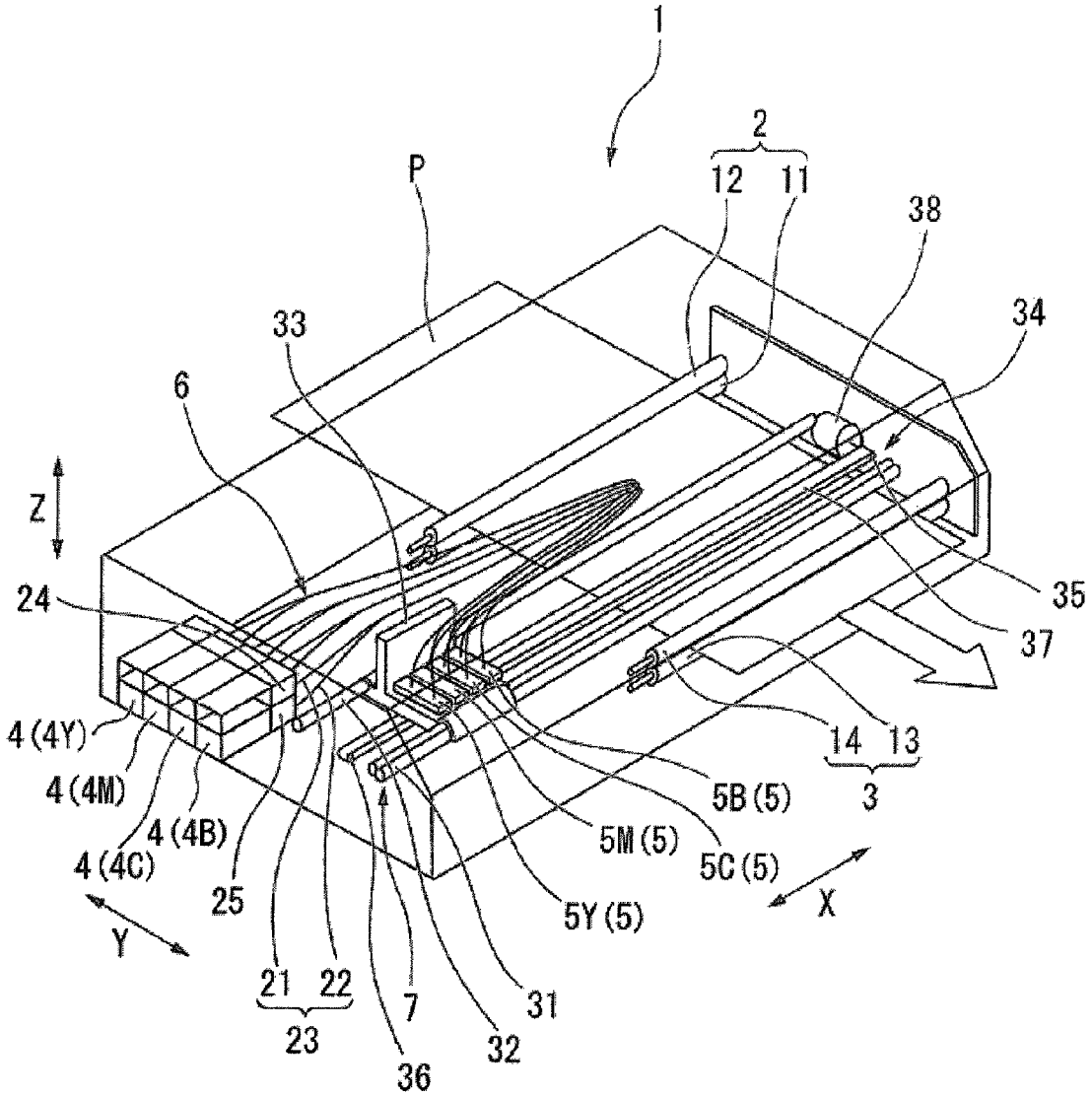
FIG. 1 is a schematic configuration diagram of an inkjet printer.

FIG. 1 is a schematic configuration diagram of a printer 1.

As illustrated in FIG. 1, the printer 1 of the present embodiment is provided with a pair of conveyance units 2 and 3 which conveys a recording paper (recording medium) P such as paper, an ink tank (liquid tank) 4 which stores ink therein, an ink jet head (liquid jet head) 5 which ejects ink in the form of liquid droplets onto the recording paper P, an ink circulation unit (circulation unit) 6 which circulates ink between the ink tank 4 and the ink jet head 5, and a scanning unit (conveyance unit) 7 which moves the ink jet head 5 in a direction that is perpendicular to a conveyance direction of the recording paper P. In the following description, the conveyance direction of the recording paper P is defined as a Y direction (first direction). Further, the direction perpendicular to the Y direction, that is, the width direction of the recording paper P is defined as an X direction. In FIG. 1, a Z direction indicates a height direction that is perpendicular to the X direction and the Y direction.

The conveyance unit 2 includes a grid roller 11 which extends in the X direction, a pinch roller 12 which extends in parallel to the grid roller 11, and a drive mechanism (not illustrated) such as a motor which rotates the grid roller 11 about the shaft thereof. Similarly, the conveyance unit 3 includes a grid roller 13 which extends in the X direction, a pinch roller 14 which extends in parallel to the grid roller 13, and a drive mechanism (not illustrated) which rotates the grid roller 13 about the shaft thereof.

The ink tank 4 includes ink tanks 4Y, 4M, 4C, and 4B which respectively store therein four colors of ink: yellow, magenta, cyan, and black, and are arranged in the Y direction.

Figure 2:
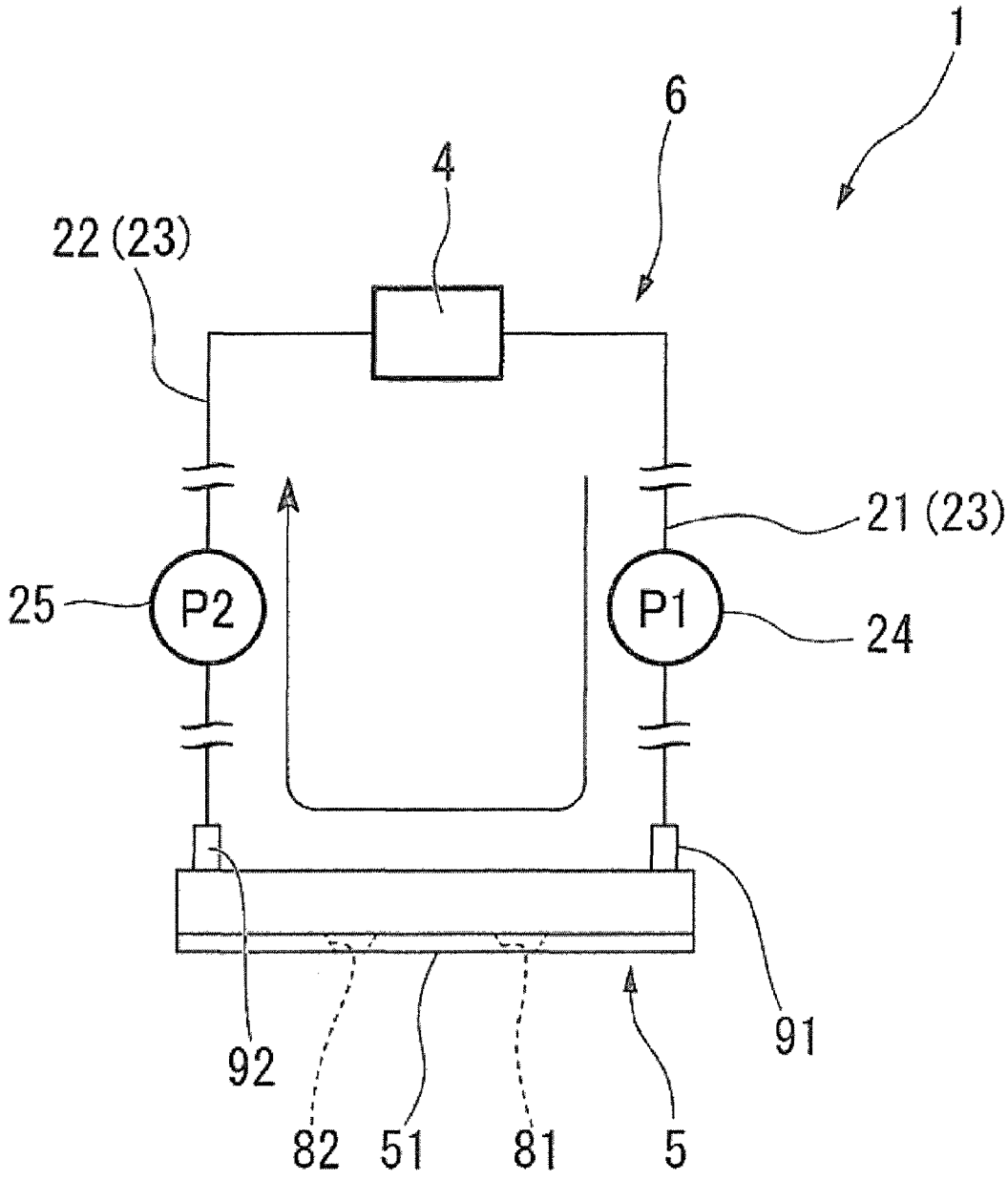
FIG. 2 is a schematic configuration diagram of an ink jet head and an ink circulation unit.

FIG. 2 is a schematic configuration diagram of the ink jet head 5 and the ink circulation unit 6.

As illustrated in FIGS. 1 and 2, the ink circulation unit 6 is provided with a circulation flow path 23 which includes an ink supply tube 21 which supplies therethrough ink to the ink jet head 5 and an ink discharge tube 22 which discharges therethrough ink from the ink jet head 5, a pressurizing pump 24 which is connected to the ink supply tube 21, and a suction pump 25 which is connected to the ink discharge tube 22. Each of the ink supply tube 21 and the ink discharge tube 22 includes a flexible hose having flexibility that can cope with the operation of the scanning unit 7 which supports the ink jet head 5.

The pressurizing pump 24 pressurizes the inside of the ink supply tube 21 to send out ink to an inlet ink chamber 110 (described below, see FIG. 7) of the inkjet head 5 through the ink supply tube 21. Accordingly, the ink supply tube 21 has a positive pressure relative to the ink jet head 5.

The suction pump 25 depressurizes the inside of the ink discharge tube 22 to suck ink from outlet ink chambers 111 (described below, see FIG. 7) of the ink jet head 5. Accordingly, the ink discharge tube 22 has a negative pressure relative to the ink jet head 5. Ink can be circulated between the ink jet head 5 and the ink tank 4 through the circulation flow path 23 by driving the pressurizing pump 24 and the suction pump 25.

As illustrated in FIG. 1, the scanning unit 7 is provided with a pair of guide rails 31 and 32 each of which extends in the X direction, a carriage 33 which can slide along the pair of guide rails 31 and 32, and a drive mechanism 34 which moves the carriage 33 in the X direction. The drive mechanism 34 is provided with a pair of pulleys 35 and 36 which are provided between the guide rail 31 and the guide rail 32, an endless belt 37 which is wound around the pair of pulleys 35 and 36, and a drive motor 38 which drives the pulley 35 to rotate.

The pulley 35 is provided between one end of the guide rail 31 and one end of the guide rail 32, and the pulley 36 is provided between the other end of the guide rail 31 and the other end of the guide rail 32. The endless belt 37 is provided between the guide rail 31 and the guide rail 32. The carriage 33 is coupled to the endless belt 37. The carriage 33 loads thereon a plurality of ink jet heads 5, namely, ink jet heads 5Y, 5M, 5C, and 5B which respectively eject four colors of ink: yellow, magenta, cyan and black, and arranged in the X direction. The conveyance units 2 and 3 and the scanning unit 7 constitute conveyance means for relatively moving the ink jet head 5 and the recording paper P.

<Ink Jet Head>

Next, the ink jet head 5 will be described in detail. The ink jet heads 5Y, 5M, 5C, and 5B have the same configuration excepting colors of ink supplied thereto. Therefore, the ink jet heads 5Y, 5M, 5C, and 5B will be collectively described as the ink jet head 5 in the following description.

Figure 3:
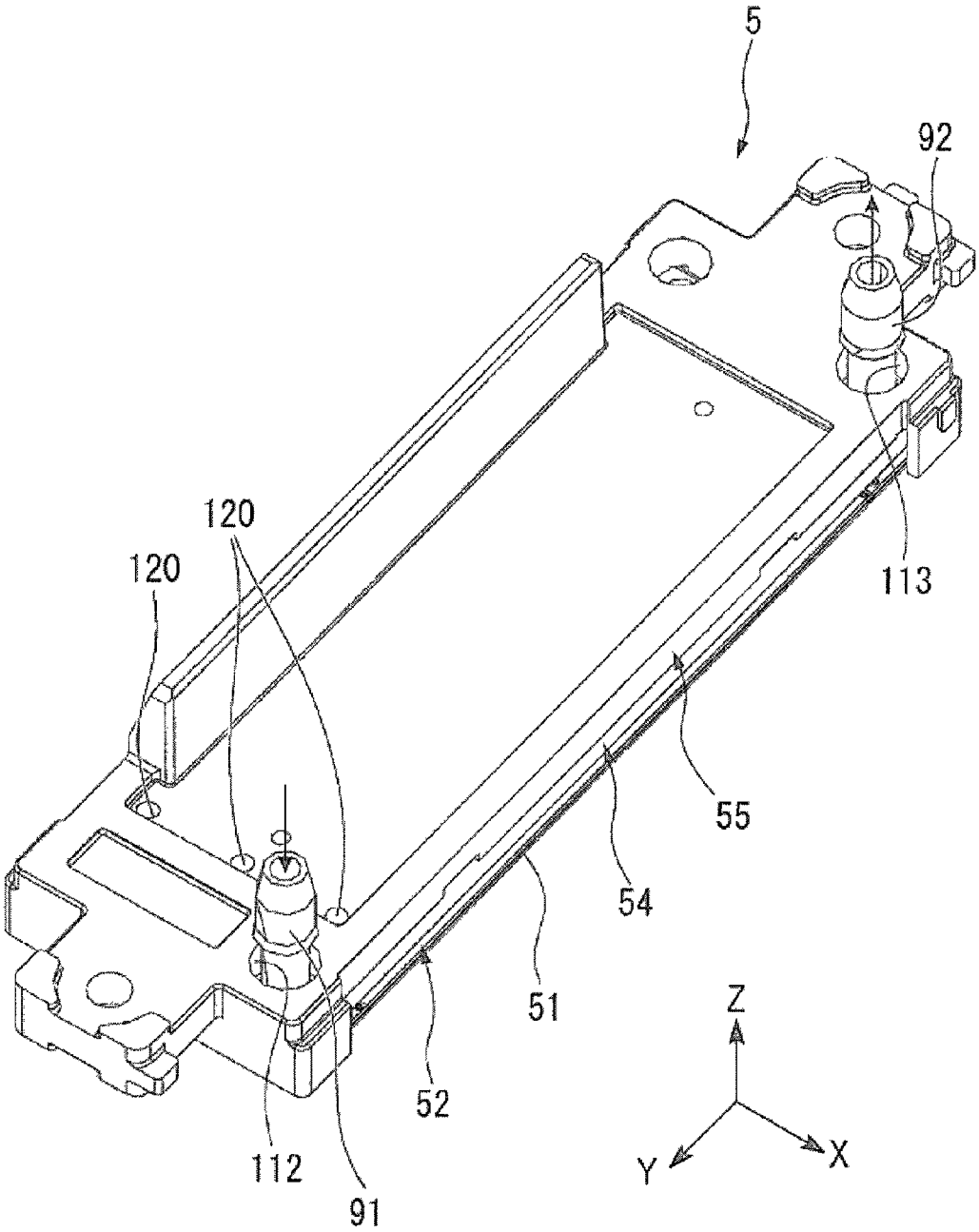
FIG. 3 is a perspective view of the ink jet head.
Figure 4:
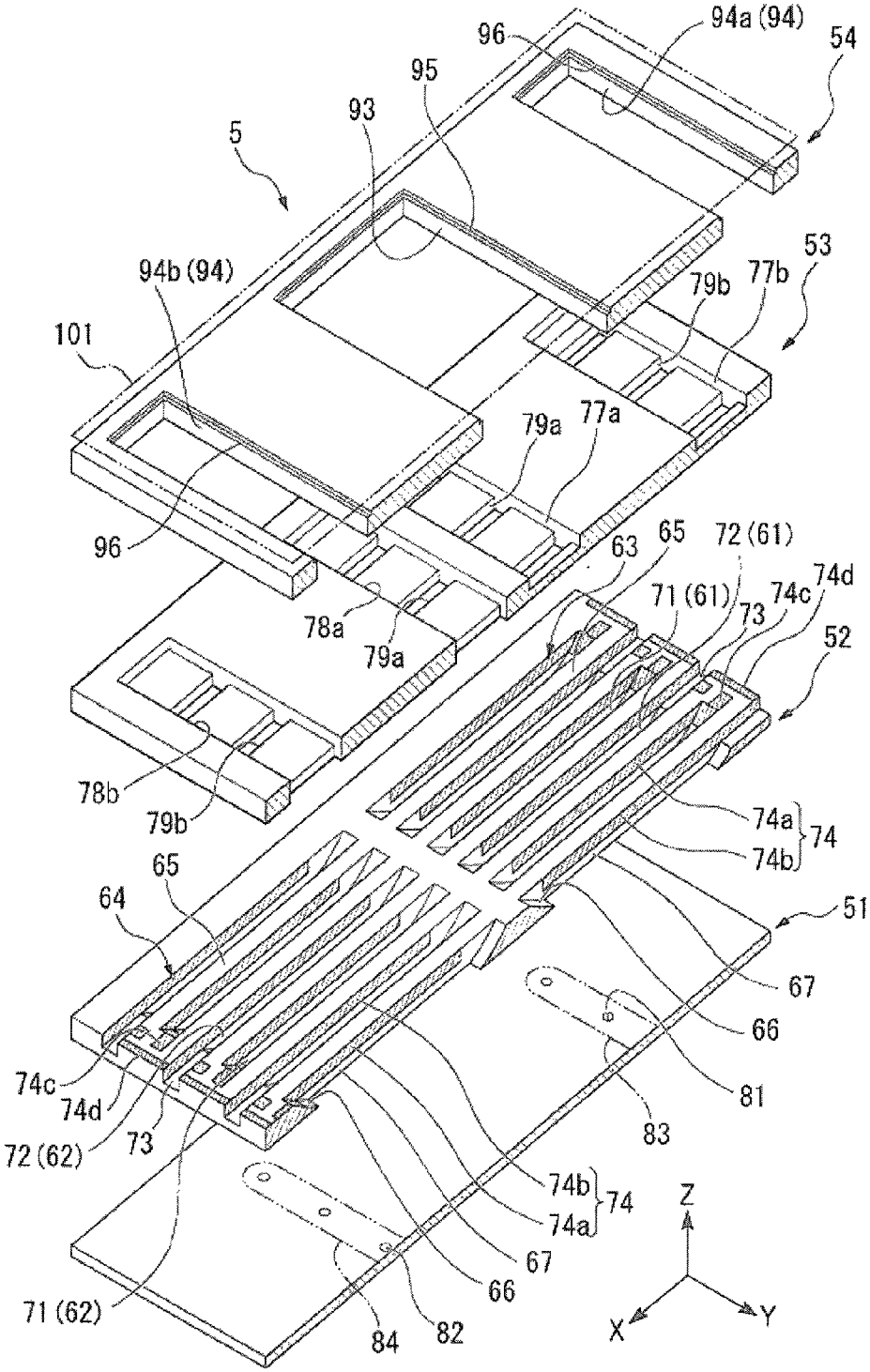
FIG. 4 is an exploded perspective view of the ink jet head.
Figure 5:
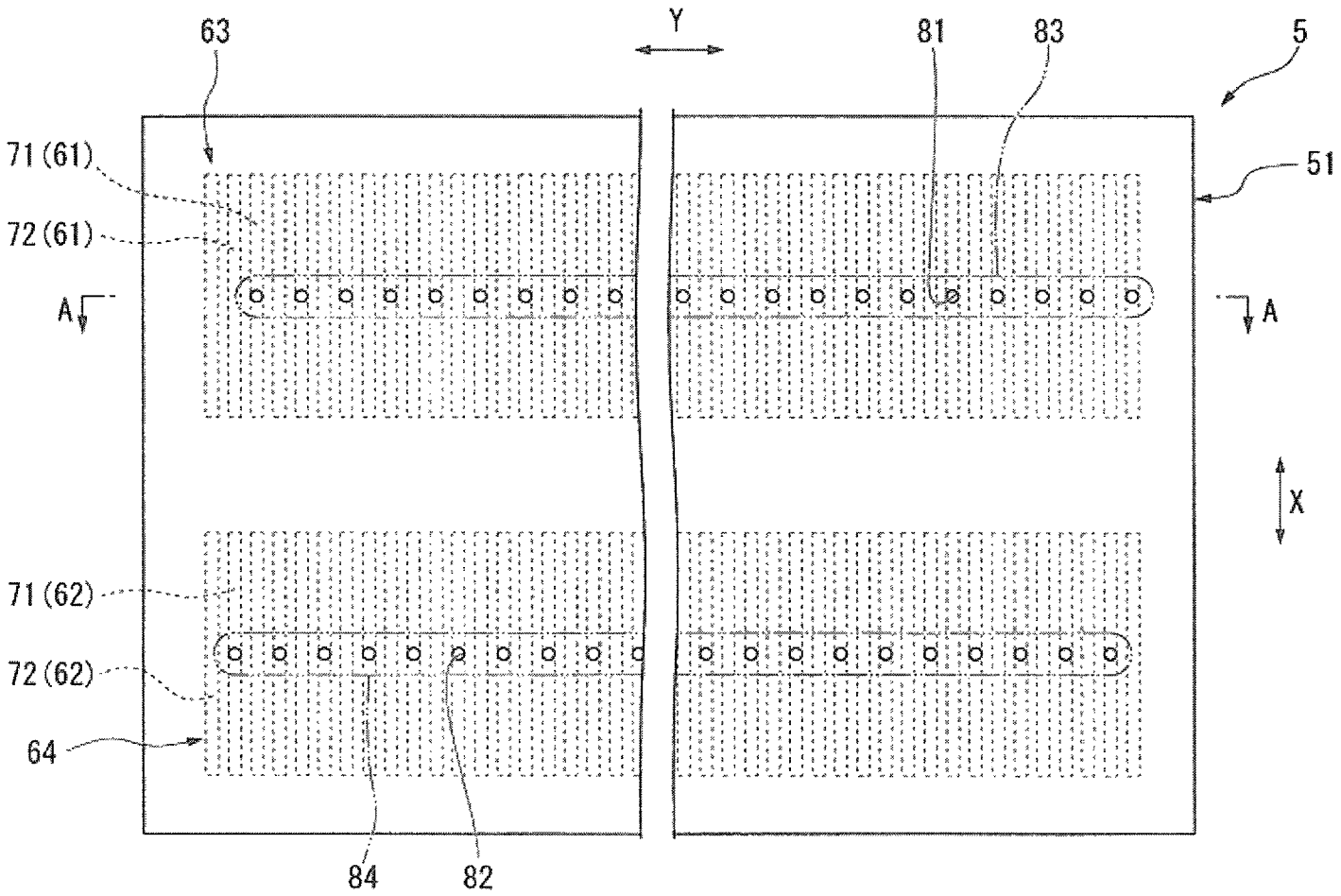
FIG. 5 is a bottom view of the ink jet head.

FIG. 3 is a perspective view of the ink jet head 5, FIG. 4 is an exploded perspective view of the ink jet head 5, and FIG. 5 is a bottom view of the ink jet head 5.

As illustrated in FIGS. 3 to 5, the ink jet head 5 is a so-called side shoot type ink jet head which ejects ink from the centers in the extending direction (X direction) of channels 61 and 62 (described below). More specifically, the ink jet head 5 is also a circulation type inkjet head which circulates ink between the inkjet head 5 and the ink tank 4. Furthermore specifically, the ink jet head 5 of the present embodiment is a two-array type ink jet head in which two nozzle arrays (jet hole arrays) which include a nozzle array 83 including a plurality of nozzle holes (jet holes) 81 and a nozzle array 84 including a plurality of nozzle holes (jet holes) 82 are formed.

The ink jet head 5 is mainly provided with a nozzle plate (jet hole plate) 51, an actuator plate 52, a cover plate 53, a flow path plate 54, and a support plate 55. In the ink jet head 5, the nozzle plate 51, the actuator plate 52, the cover plate 53, the flow path plate 54, and the support plate 55 (see FIG. 3) are laminated in this order in the Z direction with adhesive or the like. In the following description, the side at which the support plate 55 is provided is defined as an upper side and the side at which the nozzle plate 51 is provided is defined as a lower side in the Z direction.

<Actuator Plate>

Figure 6:
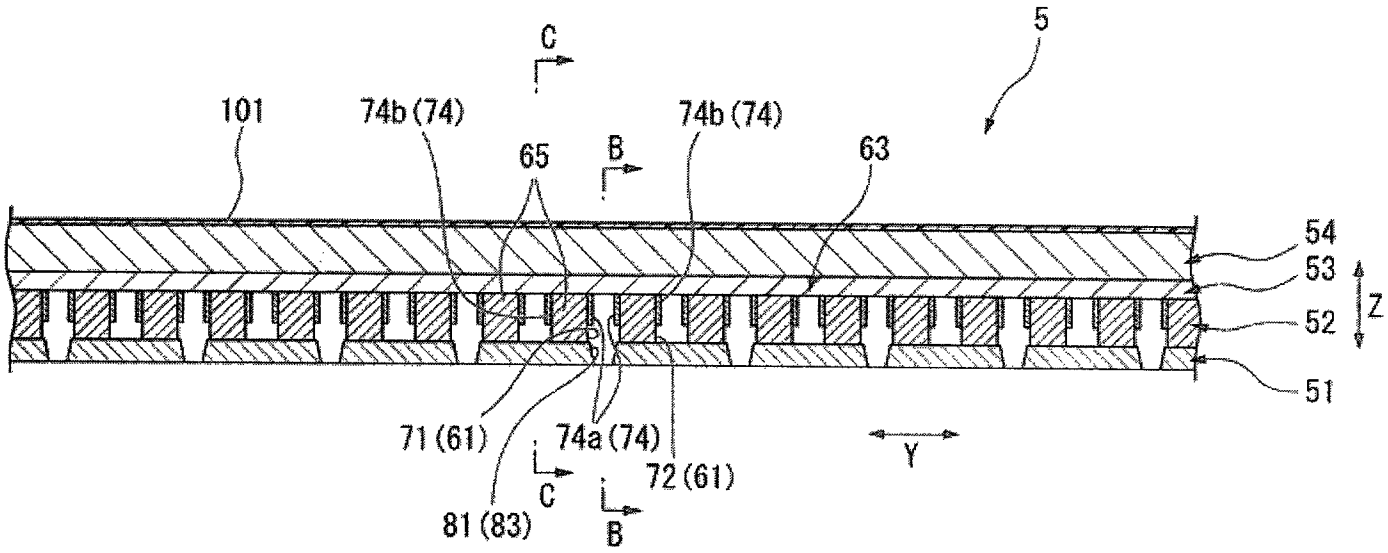
FIG. 6 is a cross-sectional view taken along line A-A of FIG. 5.
Figure 7:
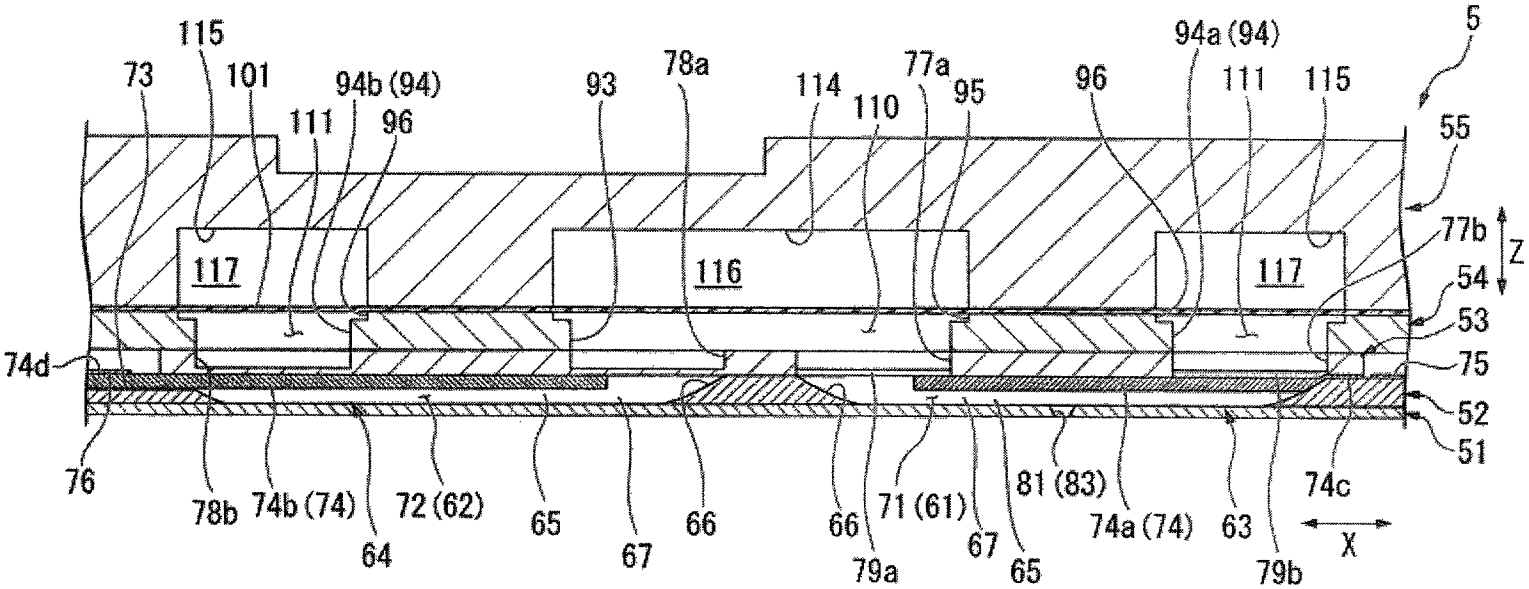
FIG. 7 is a cross-sectional view taken along line B-B of FIG. 6.
Figure 8:
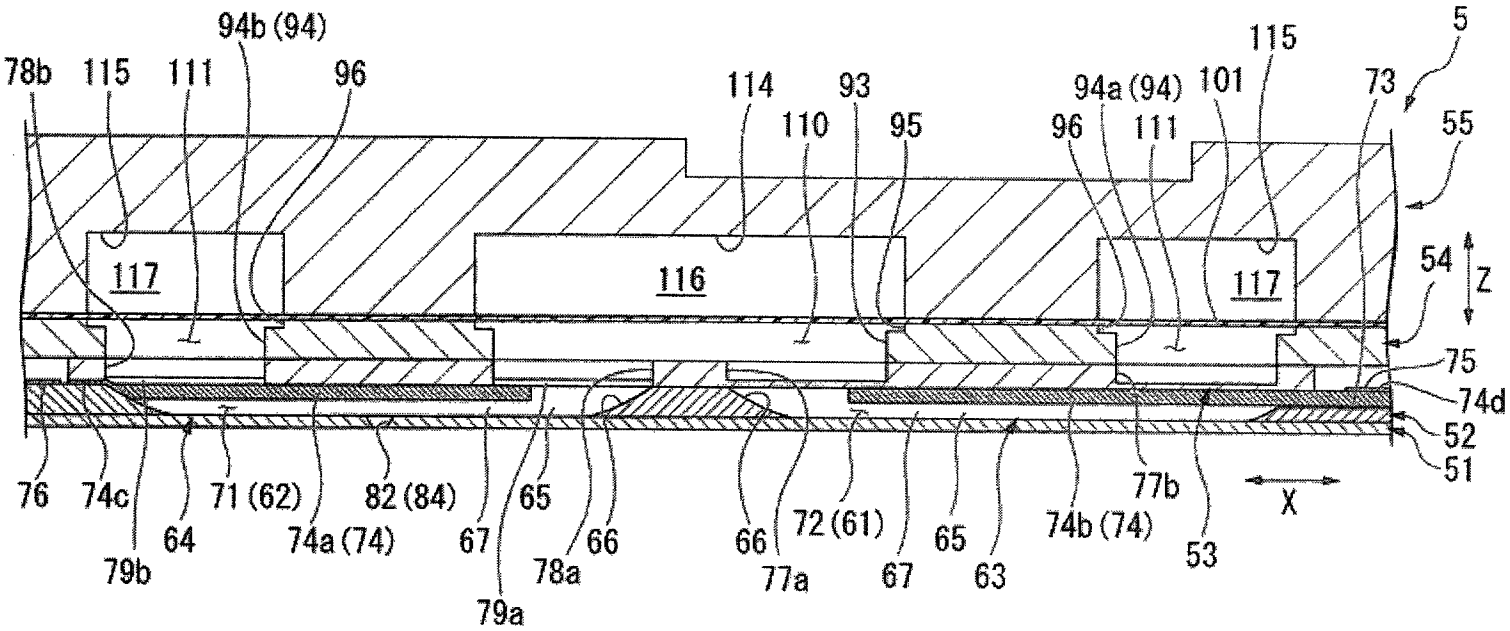
FIG. 8 is a cross-sectional view taken along line C-C of FIG. 6.

FIG. 6 is a cross-sectional view taken along line A-A of FIG. 5. FIG. 7 is a cross-sectional view taken along line B-B of FIG. 6. FIG. 8 is a cross-sectional view taken along line C-C of FIG. 6.

As illustrated in FIGS. 4 to 8, the actuator plate 52 is formed of a piezoelectric material such as lead zirconate titanate (PZT), and polarized in one direction along the thickness direction (Z direction). On the upper surface of the actuator plate 52, two rows of channel groups (a first channel group 63 and a second channel group 64) each of which includes a plurality of channels (first channels 61 and second channels 62) arranged in parallel at intervals in the Y direction are arranged. The first channel group 63 and the second channel group 64 are symmetrical to each other with respect to an axis of symmetry (not illustrated) along the Z direction. Therefore, in the following description, the first channel group 63 (the first channels 61) will be mainly described. In the second channel group 64, identical components as those of the first channel group 63 will be denoted by the same reference numerals, and description of these components will be omitted.

The first channel group 63 includes the first channels 61 each of which extends in the X direction (extending direction). The first channels 61 are arranged in parallel to each other at intervals in the Y direction. That is, each of the first channels 61 is a groove which is defined by side walls 65 formed of a piezoelectric body (actuator plate 52) and has a concave cross-sectional shape.

The first channels 61 are linearly formed at equal intervals by cutting the actuator plate 52 from the upper surface thereof using, for example, a dicing blade. Specifically, each of the first channels 61 has arc portions 66 which are located on opposite ends in the X direction thereof and have a curvature radius following the outer peripheral shape of the dicing blade and a rectangular portion 67 which is located between the arc portions 66. The rectangular portion 67 penetrates the actuator plate 52 in the thickness direction thereof (Z direction).

The first channels 61 include ejection channels 71 which eject ink therethrough and dummy channels 72 which do not eject ink therethrough. The first channel group 63 is formed by alternately arranging the ejection channels 71 and the dummy channels 72 in the Y direction. As illustrated in FIG. 8, in the actuator plate 52, shallow grooves 73 which communicate with the outer ends in the X direction of the respective dummy channels 72 are formed at positions corresponding to the respective dummy channels 72.

Drive electrodes 74 each of which extends in the X direction are formed on side surfaces of the side walls 65 of the actuator plate 52. Each of the drive electrodes 74 is formed in a region approximately half of the corresponding side wall 65 from the upper surface through the center thereof in the Z direction.

Specifically, the drive electrodes 74 include common electrodes 74*a* and active electrodes 74*b*. The common electrodes 74*a* are formed on side surfaces of the side walls 65, the side surfaces facing the ejection channels 71. The active electrodes 74*b* are formed on side surfaces of the side walls 65, the side surfaces facing the dummy channels 72.

A pair of common electrodes 74*a* formed inside the same ejection channel 71 are electrically connected to each other through a common terminal 74*c* (see FIG. 4) on the outer side in the X direction of the ejection channel 71.

Further, a pair of active electrodes 74*b* facing each other inside the same dummy channel 72 are electrically separated from each other. On the other hand, a pair of active electrodes 74*b* opposed to each other with an ejection channel 71 interposed therebetween are electrically connected to each other through an active terminal 74*d* (see FIG. 4). The drive electrodes 74 of the first channel group 63 and the drive electrodes 74 of the second channel group 64 are separately connected to a control unit respectively through a flexible substrate 75 and a flexible substrate 76 (see FIGS. 7 and 8).

The second channel group 64 is arranged with a space from the first channel group 63 in the X direction. Specifically, the second channel group 64 includes the second channels 62 which are arranged at intervals in the Y direction with the same pitch as the first channels 61. The arraying direction of the second channels 62 is parallel to the arraying direction of the first channels 61.

The ejection channels 71 and the dummy channels 72 of the second channels 62 are arranged in an alternating manner relative to the ejection channels 71 and the dummy channels 72 of the first channels 61. Therefore, in the ink jet head 5 of the present embodiment, the ejection channels 71 of the first channels 61 and the ejection channels 71 of the second channels 62 are arranged in a staggered manner.

<Nozzle Plate>

The nozzle plate 51 is formed of a film material such as polyimide having a thickness of approximately 50 μm, and formed into a sheet shape. The nozzle plate 51 is adhered to the lower surface of the actuator plate 52. On the nozzle plate 51, two nozzle arrays (a first nozzle array 83 and a second nozzle array 84) each of which includes a plurality of nozzle holes (first nozzle holes 81 and second nozzle holes 82) arranged side by side at intervals in the Y direction are arranged.

The first nozzle array 83 includes the first nozzle holes 81 each of which penetrates the nozzle plate 51 in the Z direction. The nozzle holes 81 are arranged in a straight line at intervals in the Y direction. The first nozzle holes 81 communicate with the respective ejection channels 71 of the first channels 61. Specifically, the first nozzle holes 81 are formed so as to be located on the centers in the X direction of the respective ejection channels 71 of the first channels 61 with the same pitch as the ejection channels 71.

The second nozzle array 84 includes the second nozzle holes 82 each of which penetrates the nozzle plate 51 in the Z direction. The second nozzle array 84 is arranged in parallel to the first nozzle array 83. The second nozzle holes 82 communicate with the respective ejection channels 71 of the second channel 62. Specifically, the second nozzle holes 82 are formed so as to be located on the centers in the X direction of the respective ejection channels 71 of the second channels 62 with the same pitch as the ejection channels 71. Therefore, the dummy channels 72 do not communicate with the nozzle holes 81 and 82, and are covered by the nozzle plate 51 on the bottoms thereof. Each of the nozzle holes 81 and 82 has a tapered shape whose diameter is gradually reduced downward.

<Cover Plate>

As illustrated in FIGS. 4, 7, and 8, the cover plate 53 is formed into a plate shape, and adhered to the upper surface of the actuator plate 52 so as to block the channel groups 63 and 64. The cover plate 53 has a narrower width in the X direction than the actuator plate 52. In this case, as illustrated in FIGS. 7 and 8, the common terminals 74*c* and the active terminals 74*d* are exposed on the actuator plate 52 at positions located at the outside in the X direction of the cover plate 53. The flexible substrates 75 and 76 are connected to the common terminals 74*c* and the active terminals 74*d*.

As illustrated in FIGS. 4, 7, and 8, a plurality of ink supply chambers (a first ink supply chamber 77*a* and a second ink supply chamber 78*a*) and a plurality of ink discharge chambers (a first ink discharge chamber 77*b* and a second ink discharge chamber 78*b*) are formed on the cover plate 53 so as to correspond to the channel groups 63 and 64. The first ink supply chamber 77*a* and the first ink discharge chamber 77*b* are linearly symmetrical to the second ink supply chamber 78*a* and the second ink discharge chamber 78*b* with respect to an, axis of symmetry (not illustrated) along the Z direction. Therefore, in the following description, the first ink supply chamber 77*a* and the first ink discharge chamber 77*b* will be mainly described. In the second ink supply chamber 78*a* and the second ink discharge chamber 78*b*, components that correspond to those of the first ink supply chamber 77*a* and the first ink discharge chamber 77*b* will be denoted by the same reference numerals, and description of these components will be omitted.

The first ink supply chamber 77*a* is formed into a concave groove that extends along the Y direction on the cover plate 53 at a position facing inner ends in the X direction of the first channels 61. Supply slits 79*a* each of which penetrates the first ink supply chamber 77*a* in the Z direction are formed on the first ink supply chamber 77*a* at positions corresponding to the respective ejection channels 71 (positions facing the respective ejection channels 71 in the Z direction).

The first ink discharge chamber 77*b* is formed into a concave groove that extends along the Y direction on the cover plate 53 at a position facing outer ends in the X direction of the first channels 61. Discharge slits 79*b* each of which penetrates the first ink discharge chamber 77*b* in the Z direction are formed on the first ink discharge chamber 77*b* at positions corresponding to the respective ejection channels 71 (positions facing the respective ejection channels 71 in the Z direction).

Therefore, the first ink supply chamber 77*a* and the first ink discharge chamber 77*b* communicate with the ejection channels 71 respectively through the supply slits 79*a* and the discharge slits 79*b*. On the other hand, the first ink supply chamber 77*a* and the first ink discharge chamber 77*b* do not communicate with the dummy channels 72. That is, the dummy channels 72 are blocked by the bottoms of the first ink supply chamber 77*a* and the first ink discharge chamber 77*b*.

The second ink supply chamber 78*a* is formed into a concave groove that extends along the Y direction at a position facing inner ends in the X direction of the second channels 62. The second ink discharge chamber 78*b* is formed into a concave groove that extends along the Y direction at a position facing outer ends in the X direction of the second channels 62.

Supply slits 79*a* are formed on the second ink supply chamber 78*a* and the discharge slits 79*b* are formed on the second ink discharge chamber 78*b* at positions corresponding to the respective ejection channels 71 (positions facing the respective ejection channels 71 in the Z direction). That is, the supply slits 79*a* of the second ink supply chamber 78*a* and the discharge slits 79*b* of the second ink discharge chamber 78*b* are arranged in an alternating manner relative to the supply slits 79*a* of the first ink supply chamber 77*a* and the discharge slits 79*b* of the first ink discharge chamber 77*b*.

<Flow Path Plate>

Figure 9:
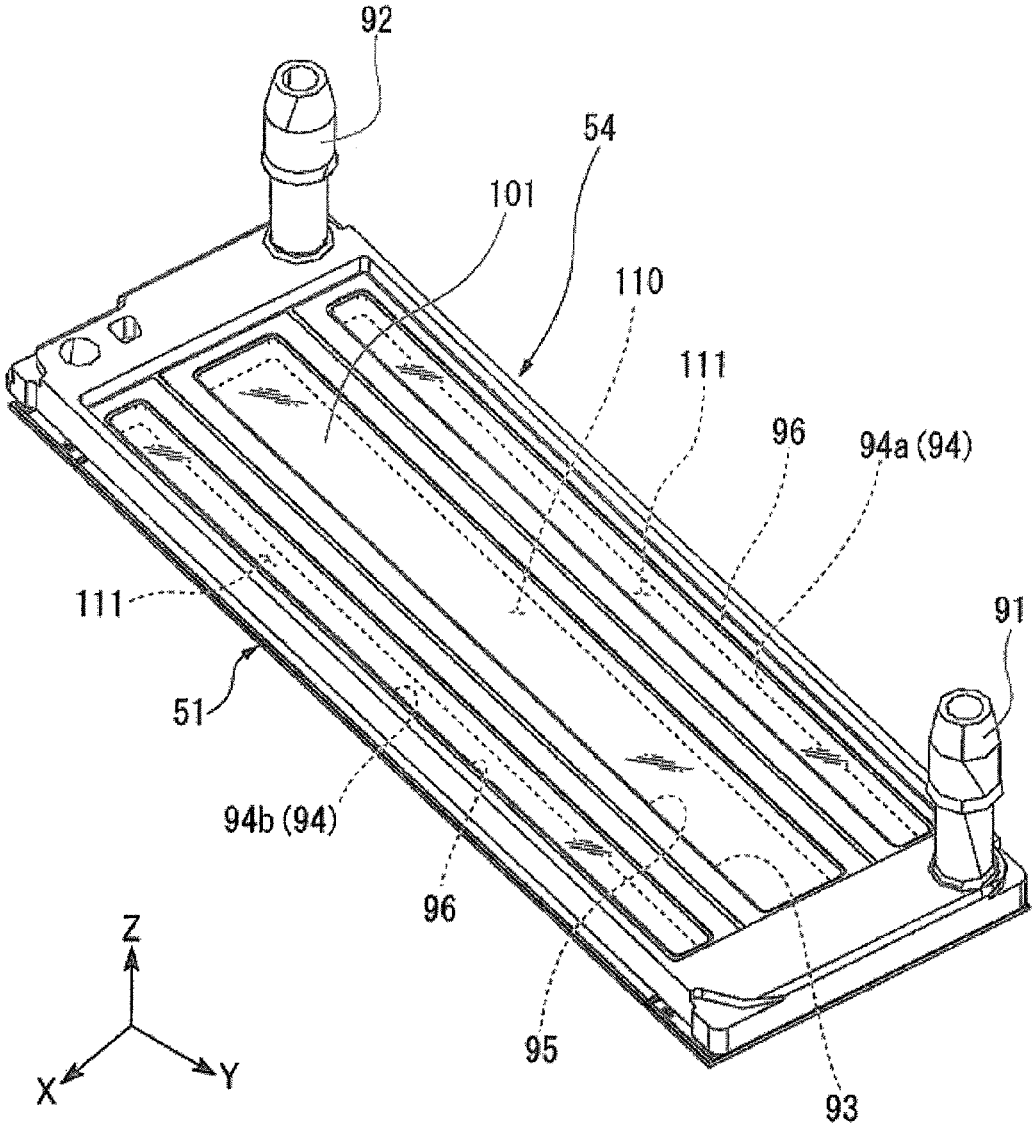
FIG. 9 is a perspective view of the ink jet head illustrating a state where a support plate is removed therefrom.
Figure 10:
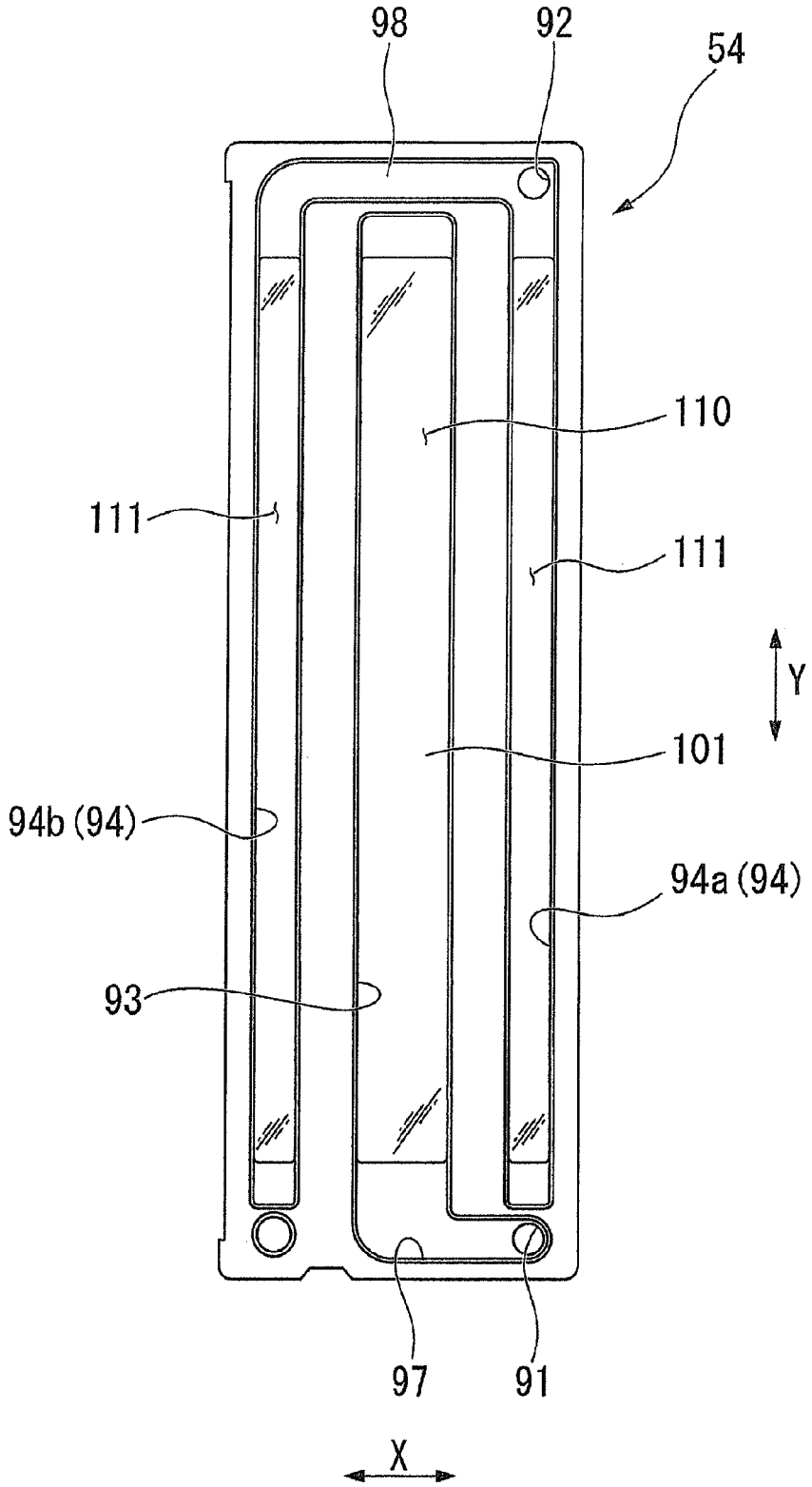
FIG. 10 is a bottom view of a flow path plate.

FIG. 9 is a perspective view of the ink jet head 5 illustrating a state where the support plate 55 is removed therefrom. FIG. 10 is a bottom view of the flow path plate 54.

As illustrate in FIGS. 7 to 10, the flow path plate 54 is formed into a plate shape, and adhered to the upper surface of the cover plate 53 so as to block the ink supply chambers 77*a* and 78*a* and the ink discharge chambers 77*b* and 78*b*. The flow path plate 54 has an ink introduction pipe 91 (see FIG. 9) and an ink lead-out pipe 92 (see FIG. 9) which are provided in a standing manner on corners thereof so as to protrude upward in the Z direction. The ink introduction pipe 91 is connected to a downstream end of the ink supply tube 21 (see FIGS. 1 and 2), and ink is supplied thereto from the ink tank 4. On the other hand, the ink lead-out pipe 92 is connected to an upstream end of the ink discharge tube 22 (see FIGS. 1 and 2), and ink that has been circulated in the ink jet head 5 is discharged therethrough. Each of the ink introduction pipe 91 and the ink lead-out pipe 92 is opened on the lower surface of the flow path plate 54.

The flow path plate 54 has a large slit (first slit) 93 and a pair of small slits (second slits) 94 having a narrower width than the large slit 93. Each of the large slit 93 and the small slits 94 penetrates the flow path plate 54 in the Z direction.

The large slit 93 extends along the Y direction on the central part in the X direction of the flow path plate 54, and communicates with the first ink supply chamber 77*a* and the second ink supply chamber 78*a*. Specifically, the large slit 93 is arranged across the first ink supply chamber 77*a* and the second ink supply chamber 78*a*, and communicates with the first channels 61 through the supply slits 79*a* of the first ink supply chamber 77*a* and the second channels 62 through the supply slits 79*a* of the second ink supply chamber 78*a*.

The small slits 94 are formed on opposite sides with respect to the large slits 93. Each of the small slits 94 extends along the Y direction. The small slits 94 include a small slit 94*a* and a small slit 94*b*. The small slit 94*a* faces the first ink discharge chamber 77*b* in the Z direction, and communicates with the first channels 61 (ejection channels 71) through the discharge slits 79*b*. Further, the small slit 94*b* faces the second ink discharge chamber 78*b* in the Z direction, and communicates with the second channels 62 (ejection channels 71) through the discharge slits 79*b*. The large slit 93 has a diameter-expanded portion 95 which is formed on an upper opening edge thereof and expanded compared to the other part. Each of the small slits 94 has a diameter-expanded portion 96 formed on an upper opening edge thereof, and expanded compared to the other part.

As illustrated in FIG. 10, an introduction groove 97 and a lead-out groove 98 are formed on the flow path plate 54. The introduction groove 97 allows the ink introduction pipe 91 and the large slit 93 to communicate with each other. The lead-out groove 98 allows the ink lead-out pipe 92 and each of the small slits 94 to communicate with each other. Each of the introduction groove 97 and the lead-out groove 98 is opened on the lower surface of the flow path plate 54. Specifically, the introduction groove 97 has an upstream end which communicates with the ink introduction pipe 91 and a downstream end which communicates with an end on a first side in the Y direction of the large slit 93, the end being located on a first side in the Y direction of the flow path plate 54.

On the other hand, the lead-out groove 98 has an upstream end which communicates with the ink lead-out pipe 92 and a downstream end which is branched into two parts communicating with ends on a second side in the Y direction of the respective small slits 94. The introduction groove 97 and the lead-out groove 98 face regions of the actuator plate 52, the regions being located on the outside of the channel groups 63 and 64 in the Y direction. Therefore, the introduction groove 97 and the lead-out groove 98 are blocked by the actuator plate 52, and do not directly communicate with the channel groups 63 and 64.

<Film Member>

As illustrated in FIGS. 7 to 10, a film member (pressure buffering portion) 101 is adhered to the upper surface of the flow path plate 54 so as to cover the slits 93 and 94. The film member 101 is a sheet having flexibility (flexible film). In the present embodiment, the film member 101 is made of a resin material such as polyamide, and has a thickness of, for example, approximately 15 μm. The film member 101 of the present embodiment is arranged throughout the entire upper surface of the flow path plate 54, so that the slits 93 and 94 are collectively covered by the single film member 101.

A space defined by the large slit 93 and the film member 101 stores therein ink supplied from the ink tank 4, and constitutes the inlet ink chamber (first common liquid chamber) 110 which communicates with the channels 61 (ejection channels 71) through the ink supply chamber 77*a* and the channels 62 (ejection channels 71) through the ink supply chamber 78*a*. In this case, the film member 101 faces the channels 61 and 62 along the opening direction of the channels 61 and 62 (Z direction). That is, the film member 101 constitutes an inner surface of the inlet ink chamber 110, the inner surface facing the first channels 61 and the second channels 62, and is warp-deformed along with pressure fluctuation inside the inlet ink chamber 110.

On the other hand, spaces defined by the small slits 94 and the film member 101 separately communicate with the channels 61 through the ink discharge chamber 77*b* and the channels 62 through the ink discharge chamber 78*b*, and constitute a pair of outlet ink chambers (second common liquid chamber) 111 which store therein ink discharged from the respective channels 61 and 62 (ejection channels 71). In this case, the film member 101 constitutes inner surfaces of the respective outlet ink chambers 111, the inner surfaces facing the first channels 61 and the second channels 62, and warp-deformed along with pressure fluctuation inside the outlet ink chambers 111.

In this manner, in the ink jet head 5 of the present embodiment, the inlet ink chamber 110 is common between the first channel group 63 and the second channel group 64. On the other hand, the outlet ink chambers 111 are separately provided for the first channel group 63 and the second channel group 64. Therefore, the area of a part of the film member 101, the part corresponding to the inlet ink chamber 110, is larger than the area of a part of the film member 101, the part corresponding to each of the outlet ink chambers 111.

<Support Plate>

As illustrated in FIG. 3, the support plate 55 is formed into a plate shape, and adhered to the upper surface of the flow path plate 54 so as to be overlapped therewith. The support plate 55 has through holes 112 and 113 which are formed at positions respectively facing the ink introduction pipe 91 and the ink lead-out pipe 92 in the Z direction. The ink introduction pipe 91 and the ink lead-out pipe 92 are respectively inserted through the through hole 112 and the through hole 113.

As illustrated in FIGS. 7 and 8, the support plate 55 has a recessed portion 114 and recessed portions 115 which are opened downward. The recessed portion 114 is formed at a position facing the inlet ink chamber 110 in the Z direction. The recessed portions 115 are formed at positions facing the respective outlet ink chambers 111 in the Z direction. Accordingly, a film sway area (sway space) 116 which is defined by the recessed portion 114 and the film member 101 is formed above the inlet ink chamber 110. Further, film sway areas (sway spaces) 117 which are defined by the recessed portions 115 and the film member 101 are formed above the respective outlet ink chambers 111.

As illustrated in FIG. 3, a plurality of air release holes 120 are formed on the support plate 55. The air release holes 120 penetrate the support plate 55 in the Z direction so as to communicate with the respective recessed portions 114 and 115 (the film sway areas 116 and 117). Each of the air release holes 120 is formed near an end on the first side in the Y direction of the support plate 55. The film member 101 which forms the ink chambers 110 and 111 are exposed to the outside through the air release holes 120.

[Method of Operating Printer]

Next, recording of a character or a figure onto the recording paper P using the printer 1 having the above configuration will be described below.

As an initial state, the four ink tanks 4 illustrated in FIG. 1 enclose therein respective different colors of ink in sufficient amount. Further, ink inside each of the ink tanks 4 is filled into the corresponding ink jet head 5 (the ink chambers 110 and 111, and the channel groups 63 and 64) through the ink circulation unit 6.

By operating the printer 1 under such an initial state, the grid roller 11 of the conveyance unit 2 and the grid roller 13 of the conveyance unit 3 rotate. As a result, the recording paper P is conveyed in the conveyance direction (Y direction) between the grid rollers 11 and 13 and the pinch rollers 12 and 14. At the same time, the drive motor 38 rotates the pulleys 35 and 36 to move the endless belt 37. Accordingly, the carriage 33 reciprocates in the X direction while being guided by the guide rails 31 and 32.

During this operation, four colors of ink is appropriately ejected onto the recording paper P from the respective ink jet heads 5. In this manner, recording of a character or an image can be performed.

Herein below, the movement of each of the ink jet heads 5 will be described in detail.

In the circulation and side shoot type ink jet head 5 as described in the present embodiment, the pressurizing pump 24 and the suction pump 25 illustrated in FIG. 2 are first operated to circulate ink inside the circulation flow path 23. In this case, ink flowing in the ink supply tube 21 passes through the ink introduction pipe 91, the inlet ink chamber 110, and each of the ink supply chambers 77*a* and 78*a*, and is then supplied to the ejection channels 71 of each of the channel groups 63 and 64 through the supply slits 79*a* as illustrated in FIGS. 7 to 9. Further, the ink inside each of the ejection channels 71 flows into each of the ink discharge chambers 77*b* and 78*b* through the discharge slits 79*b*, and is then discharged to the ink discharge tube 22 through the outlet ink chambers 111 and the ink lead-out pipe 92. The ink discharged to the ink discharge tube 22 is returned to the ink tank 4, and then again supplied to the ink supply tube 21. Accordingly, ink is circulated between the ink jet head 5 and the ink tank 4.

When the carriage 33 (see FIG. 1) starts reciprocating, the control unit applies drive voltage to the drive electrodes 74 (the common electrodes 74*a* and the active electrodes 74*b*) through the flexible substrates 75 and 76. Specifically, among the drive electrodes 74, the drive voltage is applied to the drive electrodes 74 that are formed on two side walls 65 that define an ejection channel 71 which ejects ink therefrom to deform the two side walls 65 so as to protrude toward respective dummy channels 72 that are adjacent to the ejection channel 71. The actuator plate 52 of the present embodiment is polarized in one direction, and each of the drive electrodes 74 is formed up to the intermediate position in the Z direction of the side surface of the corresponding side wall 65. Therefore, when drive voltage is applied, each of the side walls 65 is deformed into a V shape curved at the intermediate position in the Z direction thereof. As a result, the ejection channel 71 is deformed as swelling.

In this manner, the capacity of the ejection channel 71 increases due to the deformation of the two side walls 65 caused by a piezoelectric thickness slide effect. Further, since the capacity of the ejection channel 71 increases, ink stored inside the inlet ink chamber 110 is introduced into the ejection channel 71. Then, the ink introduced into the ejection channel 71 propagates as a pressure wave inside the ejection channel 71. At the timing when the pressure wave reaches the corresponding nozzle hole 81 or 82, the drive voltage applied to the drive electrodes 74 is made zero. Accordingly, the deformed side walls 65 are returned to the original shape, and the capacity of the ejection channel 71 once increased is returned to the original capacity. This operation increases the pressure inside the ejection channel 71, thereby pressurizing ink inside thereof. As a result, ink in the form of liquid droplets is ejected to the outside through the corresponding nozzle holes 81 or 82, thereby making it possible to record a character or an image on the recording paper P as described above.

In particular, since each of the nozzle holes 81 and 82 of the present embodiment has a tapered shape, it is possible to straightly eject ink with high speed and excellent straight advancing property. Therefore, it is possible to perform recording with high image quality.

In the present embodiment, the film member 101 which defines each of the ink chambers 110 and 111 is warp-deformed in response to pressure fluctuation inside the inkjet head 5, thereby buffering the pressure fluctuation. First, in the circulation type ink jet head 5 as in the present embodiment, driving of the pressurizing pump 24 and the suction pump 25 is controlled so that the pressure (nozzle pressure) near the nozzle holes 81 and 82 is constantly maintained at a negative pressure (for example, approximately −1 kPa) so as to form meniscuses inside the nozzle holes 81 and 82. Specifically, the suction force of the suction pump 25 is set to be higher than the pressurizing force of the pressurizing pump 24.

In this case, the upstream side with respect to the channel groups 63 and 64 (the same side as the inlet ink chamber 110) is maintained at a positive pressure, and the downstream side (the same side as each of the outlet ink chambers 111) is maintained at a negative pressure. Therefore, a part of the film member 101, the part corresponding to the inlet ink chamber 110, is warp-deformed toward the film sway area 116 so as to increase the capacity of the inlet ink chamber 110. On the other hand, a part of the film member 101, the part corresponding to each of the outlet ink chambers 111, is warp-deformed toward the inside of each of the outlet ink chambers 111 so as to reduce the capacity of the outlet ink chambers 111.

In such a state, when ink is ejected from a nozzle hole 81 or 82 due to the decrease (restoration) of the capacity of an ejection channel 71, the pressure inside the ejection channel 71 instantaneously decreases. Accordingly, pressure fluctuation inside the ejection channel 71 is transmitted as a pressure wave to the ink chambers 110 and 111, and the film member 101 is thereby warp-deformed. That is, the film member 101 is warp-deformed toward the ink chambers 110 and 111 so as to reduce the capacity of the ink chambers 110 and 111. As a result, it is possible to buffer the pressure fluctuation occurring inside the ejection channel 71.

In the present embodiment, the film member 101 is arranged in each of the ink chambers 110 and 111 with which the channels 61 and 62 communicate. Therefore, it is also possible to prevent so-called crosstalk in which pressure fluctuation occurring in any of the ejection channels 71 is transmitted to the other ejection channels 71 through the ink chambers 110 and 111.

In the above, pressure fluctuation that occurs when ejecting ink has been described. However, the present invention is not limited thereto. For example, also for pressure fluctuation that occurs inside the channels 61 and 62 or the ink chambers 110 and 111 due to swaying of the circulation flow path 23 when the carriage 33 moves or ink is supplied or discharged, it is possible to buffer the pressure fluctuation by the warp-deformation of the film member 101.

In this manner, in the present embodiment, the film member 101 which can be warp-deformed along with pressure fluctuation inside each of the inlet ink chamber 110 and the outlet ink chambers 111 is provided as apart of the inner surfaces of each of the ink chambers 110 and 111.

According to such a configuration, pressure fluctuation that occurs inside each of the channels 61 and 62, for example, when ejecting ink can be buffered inside the ink chambers 110 and 111. In this case, since the film member 101 is provided in each of the ink chambers 110 and 111, the pressure fluctuation that occurs inside the channels 61 and 62 can be effectively buffered. As a result, it is possible to provide the ink jet head 5 having high ejection performance (printing stability).

Further, the film member 101 is provided in all of the ink chambers 110 and 111. Accordingly, for example, when the circulation type ink jet head 5 as in the present embodiment is employed, either of the ink chambers 110 and 111 can be set as the inlet ink chamber 110 (or the outlet ink chamber 111). Therefore, a circulation direction of ink is not restricted depending on the specification of an ink system of the printer 1. As a result, it is possible to have flexibility in the configuration of the ink system.

Especially in the circulation type ink jet head 5, the inlet ink chamber 110 is maintained at a positive pressure as described above, and the film member 101 is thereby in a swelling state. Therefore, by providing the film member 101 in the inlet ink chamber 110, it is possible to ensure the warpage amount of the film member 101 due to pressure fluctuation, and thereby improve the buffer action. Further, in the present embodiment, by providing the film member 101 in all of the ink chambers 110 and 111, the film member 101 is always provided in the inlet ink chamber 110 regardless of the specification of the ink system of the printer 1. Therefore, it is possible to reliably obtain high pressure buffering effect by the film member 101.

Further, the film member 101 is provided as a part of the inner surfaces of each of the ink chambers 110 and 111, the part facing the channels 61 and 62. Therefore, pressure waves transmitted from the channels 61 and 62 are easily transmitted to the film member 101. As a result, it is possible to more effectively buffer the pressure fluctuation.

In the present embodiment, the two-array type ink jet head 5 in which the two nozzle arrays 83 and 84 are formed on the single nozzle plate 51 is employed. As a result, it is possible to narrow a dot pitch at the time of printing. Therefore, the resolution of printing can be improved.

In particular, in the two-array type ink jet head 5, by commonly using the inlet ink chamber 110 between the channel group 63 and the channel group 64, it is possible to easily ensure the area of the film member 101 in the inlet ink chamber 110. As a result, it is possible to ensure the warpage amount of the film member 101, and thereby further improve the pressure buffering effect. In addition, the diameter-expanded portions 95 and 96 are formed on the opening edges of the respective ink chambers 110 and 111. This also makes it possible to increase the area of the film member 101 while suppressing an increase in the capacity of the ink chambers 110 and 111, thereby improving the pressure buffering effect.

Further, a pressure buffering portion is formed by the separate film member 101 which blocks the large slit 93 and the small slits 94 of the flow path plate 54. As a result, a sufficient pressure buffering effect can be easily obtained irrespective of the material forming the large slit 93 and the small slits 94. In this case, it is also possible to adjust a desired pressure buffering effect, for example, by selecting the material, the thickness and the like of the film member 101.

Further, the film member 101 is formed across the large slit 93 and the small slits 94. Therefore, it is possible to reduce the number of components and improve the manufacturing efficiency compared to a configuration in which slits 93 and 94 are covered by respective different film members 101.

Further, since the film member 101 is exposed to the outside through the air release holes 120, it is possible to suppress pressure fluctuation inside the film sway areas 116 and 117 caused by temperature change or the like. As a result, the pressure buffering effect by the film member 101 can be always maintained constant.

The printer 1 of the present embodiment is provided with the ink jet head 5 described above. Therefore, it is possible to maintain a stable ejection performance for a long period of time, and provide a printer having high versatility.

Note that the technical scope of the present invention is not limited to the above embodiment, and various modifications can be made without departing from the scope of the invention.

For example, although the ink jet printer has been described as an example of the liquid jet apparatus in the above embodiment, the liquid jet apparatus is not limited to a printer. For example, the liquid jet apparatus may be a facsimile machine, an on-demand printing machine or the like.

Further, although the case where each of the nozzle arrays 83 and 84 extends in a straight form along a first direction has been descried in the above embodiment, the present invention is not limited thereto. For example, each of the nozzle arrays 83 and 84 may diagonally extends with respect to the first direction.

In addition, the shape of each of the nozzle holes 81 and 82 is not limited to a circular shape. For example, each of the nozzle holes 81 and 82 may have a polygonal shape such as a triangular shape, an elliptical shape, and a star shape.

Further, although the two-array type ink jet head 5 in which the two nozzle arrays 83 and 84 are arranged has been described in the above embodiment, the present invention is not limited thereto. The ink jet head 5 may have one nozzle array or a plurality of nozzle arrays such as three or more nozzle arrays.

Further, although the inlet ink chamber 110 is formed as the first common liquid chamber which is common between the channel group 63 and the channel group 64 in the above embodiment, the present invention is not limited thereto. The pair of outlet ink chambers 111 may be used as the first common liquid chamber which is common between the channel group 63 and the channel group 64.

Further, although, among side shoot type ink jet heads, the circulation type ink jet head 5 in which the first common liquid chamber is set as the inlet ink chamber 110 and the second common ink chamber is set as the pair of outlet ink chambers 111 to circulate ink between the inkjet head 5 and the ink tank 4 has been described in the above embodiment, the present invention is not limited thereto. For example, the ink jet head 5 may be a non-circulation type ink jet head in which both of the first common liquid chamber and the second common liquid chamber are made function as inlet ink chambers, and ink is supplied to the ejection channels 71 from the two inlet ink chambers.

Also in this case, since the pressure buffering portion is arranged in each of the common liquid chambers, it is possible to effectively buffer pressure fluctuation inside the ink jet head.

Further, although the configuration in which the film member 101 is arranged as surfaces of the ink chambers 110 and 111, the surfaces facing the channels 61 and 62, has been described in the above embodiment, the present invention is not limited thereto. It is only required that the film member 101 is arranged as a part of the inner surfaces of each of the ink chambers 110 and 111.

Further, in the above embodiment, the case where the film member 101 is employed as the pressure buffering portion having flexibility has been described. However, the present invention is not limited thereto, and various configurations can be employed. For example, a part of the inner surfaces that define each of the ink chambers 110 and 111 may be made thinner than the other part thereof.

Further, in the above embodiment, the configuration in which the diameter-expanded portions 95 and 96 are formed on the ink chambers 110 and 111 to ensure the area of the film member 101 that can be warp-deformed has been described. However, the adhesion region between the film member 101 and the flow path plate 54 may be adjusted to thereby ensure the area of the film member 101 that can be warp-deformed.

In addition to the above, the components in the above embodiment can be appropriately replaced with well-known components and the above modified examples may be appropriately combined without departing from the scope of the invention.

What is claimed is:

1. A liquid jet head comprising:

a jet hole plate including at least one jet hole array having a plurality of jet holes configured to jet liquid therefrom, the jet holes being arranged side by side along a first direction;

an actuator plate laminated on the jet hole plate, the actuator plate including at least one channel group having a plurality of channels communicating with the jet holes, the channels being arranged in parallel at intervals along the first direction; and a first common liquid chamber and a second common liquid chamber both communicating with the channels on opposite ends in an extending direction of the channels, wherein a pressure buffering portion configured to be warp-deformable along with pressure fluctuation inside the first common liquid chamber and the second common liquid chamber is arranged as a part of inner surfaces of each of the first common liquid chamber and the second common liquid chamber.

2. The liquid jet head according to claim 1, wherein the pressure buffering portion is arranged as a part of the inner surfaces of each of the first common liquid chamber and the second common liquid chamber, the part facing the channels.

3. The liquid jet head according to claim 1, wherein the jet hole plate includes a plurality of jet hole arrays, and the actuator plate includes a plurality of channel groups, and the first common liquid chamber communicates with ends on a first side in the extending direction of the channels in one of the channel groups and ends on a second side in the extending direction of the channels in another one of the channel groups adjacent to the one channel group.

4. The liquid jet head according to claim 1, wherein a sway space configured to allow warp-deformation of the pressure buffering portion is defined on an outer surface side of the pressure buffering portion, and the sway space communicates with the outside through an air release hole.

5. The liquid jet head according to claim 1, wherein the first common liquid chamber and the second common liquid chamber are defined by a first slit and a second slit both communicating with the channels and the pressure buffering portion configured to block the first slit and the second slit, and the pressure buffering portion is a flexible film configured to be warp-deformable.

6. The liquid jet head according to claim 5, wherein the flexible film is formed across the first slit and the second slit.

7. A liquid jet apparatus comprising:

the liquid jet head according to claim 1;

a conveyance unit configured to relatively move the liquid jet head and a recording medium;

a liquid tank configured to store therein the liquid; and a circulation unit configured to circulate the liquid between the liquid jet head and the liquid tank.

* * * * *